United States Patent [19]

Lee et al.

[11] Patent Number: 4,591,673

[45] Date of Patent: May 27, 1986

[54] FREQUENCY OR TIME DOMAIN SPEECH SCRAMBLING TECHNIQUE AND SYSTEM WHICH DOES NOT REQUIRE ANY FRAME SYNCHRONIZATION

[76] Inventors: Lin-Shan Lee, Dept. of Electric Engineering, National Taiwan University, No. 1, Sec. 4, Roosevelt Rd., Taipei; Ger-Chih Chou, No. 10-1, Ping-Lang Rd., Hsing-Tien City, Taipei Hsien; Ching-Sung Chang, No. 47-1, Lane 79, Ching-An Rd., Chung-Ho City, Taipei Hsien, all of Taiwan

[21] Appl. No.: 376,607

[22] Filed: May 10, 1982

[51] Int. Cl.[4] ..... H04K 1/04

[52] U.S. Cl. ..... 179/1.5 R; 178/22.17; 178/22.1

[58] Field of Search ..... 179/1.5 R; 178/22.17, 178/22.1

[56] References Cited

U.S. PATENT DOCUMENTS

| | | | |
|---|---|---|---|
| 2,183,248 | 12/1939 | Reisz | 179/1.5 R |
| 2,243,089 | 5/1941 | Dudley | 381/37 |
| 2,411,206 | 11/1946 | Guanella | 179/1.5 R |
| 2,510,338 | 6/1950 | Guanella | 179/1.5 R |
| 2,586,475 | 2/1952 | Milliquet | 179/1.5 R |
| 2,726,283 | 12/1955 | Di Toro | 370/118 R |
| 2,908,761 | 10/1959 | Raisbeck | 381/38 |
| 2,920,287 | 1/1960 | Richman | 179/1.5 R |
| 3,090,837 | 5/1963 | Persch | 179/1.5 R |
| 3,202,764 | 8/1965 | Adams et al. | 179/1.5 R |
| 3,341,659 | 9/1967 | Stern | 179/1.5 R |
| 3,638,121 | 1/1972 | Spilker, Jr. | 179/1.5 R |
| 3,773,977 | 10/1973 | Guanella | 179/1.5 R |
| 3,979,558 | 9/1976 | Peterson | 179/1.5 R |
| 3,995,115 | 11/1976 | Kelley | 179/1.5 R |
| 4,020,285 | 4/1977 | Branscombe | 179/1.5 R |
| 4,052,565 | 10/1977 | Baxter et al. | 179/1.5 R |
| 4,058,094 | 1/1978 | Schmid et al. | 179/1.5 R |
| 4,100,374 | 7/1978 | Jayant et al. | 179/1.5 R |
| 4,149,035 | 4/1979 | Frutiger | 179/1.5 R |
| 4,179,586 | 12/1979 | Mathews, Jr. et al. | 179/1.5 R |
| 4,188,506 | 2/1980 | Schmid et al. | 179/1.5 R |
| 4,232,194 | 11/1980 | Adams | 179/1.5 R |
| 4,278,840 | 7/1981 | Morgan et al. | 179/1.5 R |
| 4,305,152 | 12/1981 | Asakawa et al. | 179/1.5 R |
| 4,393,276 | 7/1983 | Steele | 179/1.5 R |
| 4,433,211 | 8/1984 | McCalmont et al. | 179/1.5 R |
| 4,443,660 | 4/1984 | DeLon | 179/1.5 R |

OTHER PUBLICATIONS

"Short Term Spectral Analysis, Synthesis and Modification by Discrete Fourier Transform", IEE Transactions on Acoustics, Speech, and Signal Processing, vol. ASSP-25, No. 3, Jun. 1977, by Jont B. Allen.

"Digital Signal Processing", The Discrete Fourier Transform, by Alan V. Oppenhein (1972).

Digital Processing of Speech Signals, "Short-Time Fourier Analysis", by Lawrence R. Rabiner and Ronald W. Schafer, (1979), Prentice-Hall, Inc., pp. 250-354.

"A New Time Domain Speech Scrambling System Which Does Not Require Frame Synchronization", IEEE Journal on Selected Areas in Communications, vol. SAC-2, No. 3, May 1984, by Lin-Shan Lee and Ger-Chih Chou.

"A New Frequency Domain Speech Scrambling System Which Does Not Require Frame Synchronization", IEEE Transactions on Communications, vol. Com-32, No. 4, Apr. 1984, by Lin-Shan Lee, Ger-Chih Chou and Ching-Sung Chang.

"An Efficient Time Domain Sample Value Scheme Eliminated Frame Snyc. Req. For Speech . . . ", Lee et al., 11/82.

"A New Frequency Domain Speech Scrambling System Which Does Not Require Frame Synchronization", Lee et al., 12/82.

*Primary Examiner*—Salvatore Cangialosi

*Attorney, Agent, or Firm*—Cushman, Darby & Cushman

[57] ABSTRACT

The present invention relates to speech scrambling techniques and systems and in particular to a frequency or time domain speech scrambling technique and system which does not require any frame synchronization.

This invention is a technique and system for scrambling speech signal in frequency or time domain by means of speech analysis-synthesis techniques.

The system described above is very attractive because it has avoided the frame synchronization problem. The existing analog telephone channel can be utilized directly for transmission because bandwidth expansion is completely controllable. In addition, the "key space" is very large and a high degree of security can be achieved.

9 Claims, 13 Drawing Figures

FREQUENCY OR TIME DOMAIN SPEECH SCRAMBLING TECHNIQUE AND SYSTEM WHICH DOES NOT REQUIRE ANY FRAME SYNCHRONIZATION

BACKGROUND OF THE INVENTION

The present invention relates to speech scrambling techniques and systems and in particular to a frequency or time domain speech scrambling technique and system which does not require any frame sychronization.

Communication security has become one of the major problems in signal transmission and is getting more and more massive and complicated due to the rapid progress in communication developments.

At present the newest technique of secure speech communications is the use of a scrambled digital signal by the sender to transmit digits to receiver who in turn descrambles digital signal in conformity with sender's scrambling transform them into an analog signal. However, this means of communication includes the following disadvantages:

1. Apparently, the sender and receiver require very accurate synchronization. This process not only makes implementation difficult and cost higher, but also is subject to transmission interruption under poor channel conditions.

2. The current cost of setting up digital transmission facility is high.

The purpose of this invention is to provide improvements in transmission techniques subject to the above technical disadvantages, so that the synchronization problems can be solved (synchronization is not required) and a speech scrambling method offering a high degree of security is introduced. However, the means of signal communications adopted in this invention is still the conventional linear mode of transmission, i.e., analog transmission.

SUMMARY OF THE INVENTION

The primary processing method in this invention to transform speech signal waveform is to cut it into numerous segments. The following is a full description of the method to process speech signal segment by the sender (transmitter) and receiver, respectively.

1. Processing Steps for the Transmitter (1) Transform the selected speech signal segment into N digital signal samples using an A/D converter.

(2) Process several segments of the above digital signal samples to form a vector using a predetermined procedure.

(3) To scramble the speech process, the vector described above in (2) in the order: perform a Fast Fourier Transform (FFT), denoted by W on the vector, multiply by a cryptograph matrix M of N×N and perform an Inverse Fast Fourier Transform (IFFT) $W^{-1}$, denoted by; or directly scramble by performing a linear combination of "multiple uniform permutation" T.

(4) Re-process the scrambled vector described in (3) above according to the reverse procedure stated in (2) above.

(5) Transform the foregoing digital signal in (4) into analog signal through D/A converter, and then transmit the analog signal to receiver.

2. Processing Steps of the Receiver (1) Transform each of the received speech signal segments into N digital signal samples using a A/D converter (same process as in para. 1 (1))

(2) Process several segments of the above digital signal samples to form a vector according to the same procedure stated in para. 1 (2) above.

(3) To descramble, process the vector described in (2) above in the order: perform an FFT W, multiply by cryptograph matrix $M^{-1}$ of N×N which is the inverse of M and perform an inverse FFT $W^{-1}$; or directly descramble by performing an inverse linear combination of "multiple uniform permutation" $T^{-1}$. (This step is just the inverse way of para. 1(3))

(4) Re-process the vector stated in (3) above according to the reverse procedure of the one described in 1 (2) above.

(5) Transform the foregoing digital signal in (4) into the speech signal segment originally transmitted and selected using a D/A converter.

In view of the foregoing it is apparent that every step taken to process speech signal by both the sender and receiver is mutually complementary (inverse).

The specific structure of this invention is formed in compliance with the foregoing principles. The primary method is based on microprocessor techniques and will be stated in detail during describing an exemplary embodiment.

BRIEF DESCRIPTION OF THE DRAWINGS

Preferred exemplary embodiments of the present invention are described in the following detailed description taken in connection with the accompanying drawing wherein.

DETAILED DESCRIPTION OF THE PREFERRED EXEMPLARY EMBODIMENT

Figure 1:
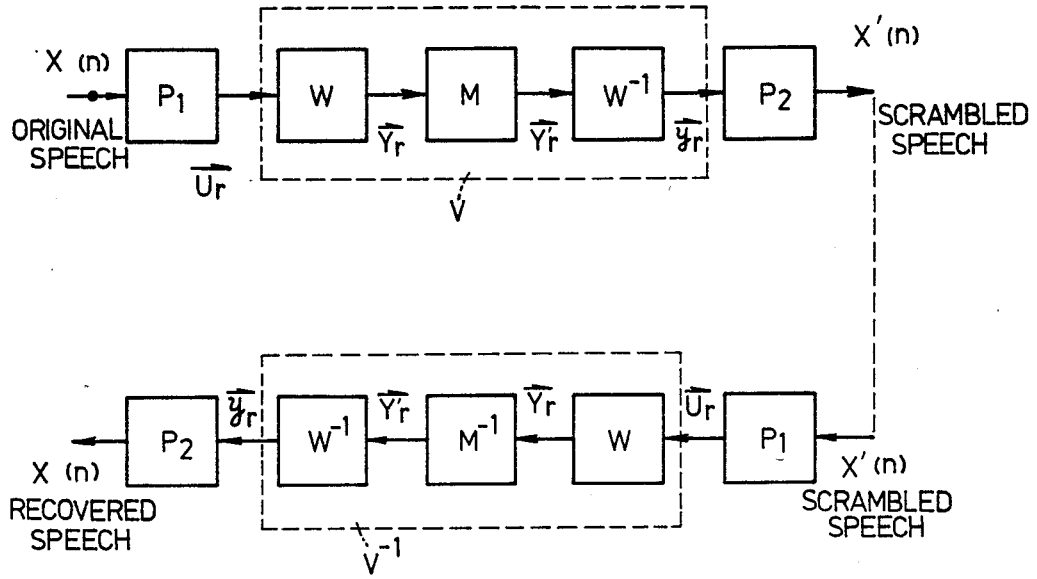
FIG. 1 is a block schematic flowchart of a first embodiment of speech scrambling and descrambling processes in accordance with the present invention.
Figure 2:
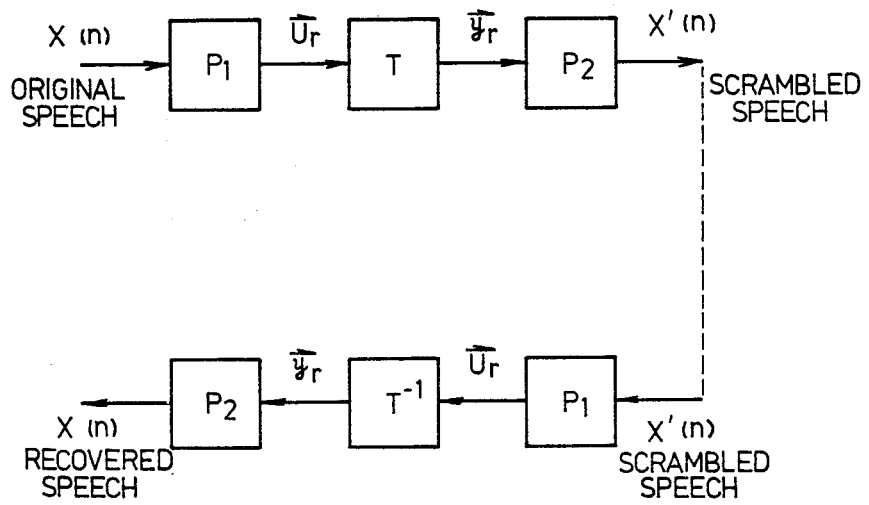
FIG. 2 is a block schematic flowchart of a second embodiment of speech scrambling and descrambling processes in accordance with the present invention.
Figure 3:
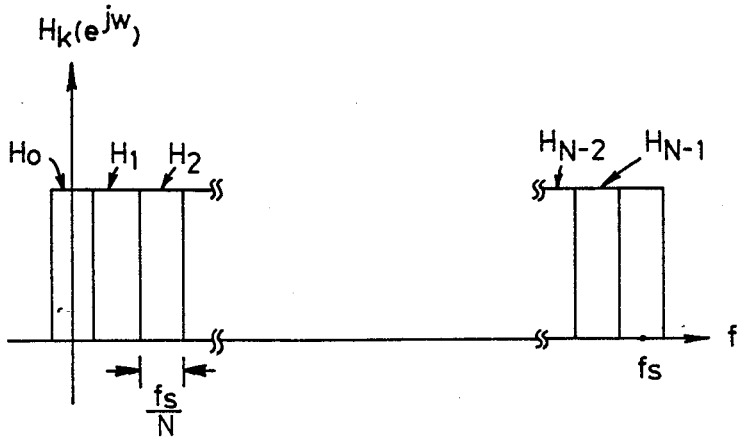
FIG. 3 is a diagram showing N ideal filters in a filter bank in accordance with the present invention.

The basis of the present invention is shown in FIGS. 1 and 2, flowcharts of scrambling and descrambling processes. In fact, FIG. 2 is another form of FIG. 1. FIG. 3 is the N ideal filters in the filter bank, and FIGS. 4~11 are the exemplary embodiment of the invention presented in this description. The detailed description is made in four parts below.

1. THEORY OUTLINE

We have discussed in the paragraph of "Summary of the Invention" the basic theory of the invention; FIGS. 1 and 2 indicate its essential structure. Block $P_1$ represents the operations explained in paragraph 1, sections 1(1)(2), and paragraph 2, sections 2(1)(2). Block $P_2$, represents the functions as stated in sections 1(4)(5) and 2(4)(5). Therefore, $P_1$ and $P_2$ are indeed two blocks with inverse operation to each other. In addition, the Block V and $V^{-1}$ (the dot lined blocks) also represent invert operations of each other corresponding to section 1(3) and 2(3). Further description is made as follows.

1-1. Frequency and Time Domain Scrambling and Descrambling Operations

Referring now to FIG. 1, $\{x(n), n=0,1,2\ldots\}$ are the samples of the original speech signal. The vector $\vec{U}_r$ is obtained after operation $P_1$ is performed on x(n), where $P_1$ and $P_2$ operations will be described later, and $$\vec{U}_r = U_{rR}(10), U_{rR}(1), \ldots U_{rR}(N-1)^T \quad r = 0, 1, 2 \ldots \tag{1}$$

here $\vec{U}_r$ is an N-component vector, whose components $\{U_{rR}(q), q=0,1,\ldots N-1\}$, are time domain samples of the speech signal but rearranged and processed by the predetermined procedure of $P_1$ as described later. R is an integer, $R \leqq N$, representing the period at which the vector $\vec{U}_r$ is obtained, i.e., a new vector $\vec{U}_r$ will be obtained after every additional R speech samples x (n) is processed by $P_1$. This will be clearer after the operation of $P_1$ is described. The block W in FIG. 1 converts the vector $\vec{U}_r$ by FFT, into another vector $Y_r$, i.e., $$\{Y_{rR}(k), k=0,1,\ldots N-1\} = DFT\{U_{rR}(q), q-0,1\ldots N-1\} \tag{2}$$

$$\vec{\vec{Y}}_r = [Y_{rR}(o), Y_{rR}(l)\ldots Y_{rR}(N-1)]^T \tag{3}$$

where "DFT" represents the function of Discrete Fourier Transform. For a more complete description of the DFT function, reference is made to Alan V. Oppenheim et al, "Digital Signal Processing", Prentice-Hall, Inc., Chapter 3. The N components, $\{Y_{rR}(K), K=0, 1, \ldots N-1\}$ of the new vector $\vec{Y}_r$ in fact represent the samples of the "short-time frequency spectrum" of the original speech signal X(n) at time n=rR. For a more complete description of the "short-time Spectral Analysis and Synthesis and Modification by Discrete Fourier Transform", see IEEE Transactions on Acoustics, Speech, and Signal Processing, Vol. ASSP-25, No. 3, June 1977, pp. 235–238. In other words, $Y_{rR}(K)$ represents the frequency component of the original Speech Signal in the $K^{th}$ frequency band at time n=rR. Using vector notations, let W be the N×N matrix for DFT, then $$\vec{\vec{Y}}_r = W\vec{U}_r \tag{4}$$

i.e., the "DFT" function can be represented by a matrix multiplication, and, as described later, can be realized and implemented using microprocessors and Fast Fourier Transform (FFT) algorithms. Multiplying $\vec{\vec{Y}}_r$ by an N×N cryptograph matrix M, i.e., $$\vec{Y}_r' = M\vec{Y}_r \tag{5}$$

and then taking Inverse Discrete Transform ($W^{-1}$ in-vector notation and using Inverse Fast Fourrier Transform algorithm for realization), one obtains $$\vec{\vec{Y}}_r = W^{-1}\vec{Y}_r' = W^{-1}MW\vec{U}_r = V\vec{U}_r \tag{6}$$

where $$V = W^{-1}MW \tag{7}$$

represents the combined effect of Discrete Fourier Transform, the Cryptograph matrix M, and the Inverse Discrete Fourier Transform, as indicated in FIG. 1. Thus, the input vector $\vec{U}_r$ is processed into the scrambled output vector $\vec{\vec{Y}}_r$, i.e., Cryptograph Scrambling M is added into the frequency domain vectors $\vec{Y}_r$ to change it into $\vec{Y}_r'$. After passing through the block $P_2$, the vector $\vec{Y}_r$ is converted back into an analog signal. The scrambled speech X'(n) is ready to be transmitted. At the receiver, again assume the input speech after passing through $P_1$ is converted into digital form $U_r$. Repeating the above process but changing the cryptograph matrix M into its inverse, $M^{-1}$, one obtains $$Y_r = W^{-1}M^{-1}WU_r = Y^{-1}U_r \tag{8}$$

The output vector $Y_r$, after passing through the block $P_2$, will give the recovered speech X(n), as indicated in FIG. 1.

It has been proven theoretically that, as long as the Blocks $P_1$ and $P_2$ are processed according to the method described hereafter, synchronization is not required for descrambling. This is the frequency domain scrambling technique.

Another method to scramble and descramble in time domain is shown in FIG. 2, the Blocks $P_1$ and $P_2$ are the same as shown in FIG. 1, while Block T represents is multiplying the vector $U_r$ by a linear combination of Uniform Permutation matrices, i.e.

$$T = \sum_{i=0}^{N-1} a_i B_{K1}, i \tag{9}$$

is the matrix for the multiplication, where $a_i$ are real numbers and $B_{K1}, i$ is the uniform permutation matrix of order $K_1$ and class i, defined as $$B_{K1}, i = [b_{rs}]_{r,s=0,1,\ldots N-1} \qquad b_{rs} = \begin{cases} 1, s = ((K_1 r + i))_N \\ 0, s \neq ((K_1 r + i))_N \end{cases} \tag{10}$$

where ((t))N represents T modulo N, and $K_1$ is an integer prime to N thus, their relation is $$\vec{\vec{Y}}_r = T\vec{U}_r \tag{11}$$

$$\vec{\vec{Y}}_r = T^{-1}\vec{U}_r \tag{12}$$

for scrambling and descrambling, respectively.

It can be proven theoretically that if the matrix T is selected as a "linear combination of uniform permutation" as stated above the inverse "$T^{-1}$" used to descramble is also a "linear combination of uniform permutation matrices". Such a system does not require synchronization to descramble, i.e., the original speech can be correctly recovered by the receiver without synchronization. This is because what it actually does is to perform the above frequency domain scrambling processes (which do not require frame synchronization) without having to go into the frequency domain. This time domain scrambling method is even easier to realize and implement practically than the frequency domain method described earlier.

1-2. Theory of Filter Bank Speech Analysis and Synthesis

An ideal filter bank is shown in FIG. 3 as a series of N of ideal bandpass filters (H0 . . . $H_{N-1}$) with equal bandwidth in the spectrum. After being passed through this filter bank, the frequency components of the speech signal will be detected. This set of frequency components can be processed by the foregoing method of scrambling and descrambling and then an output speech waveform can be obtained by interpolating. As in FIG. 3, suppose X(n) are the input speech sample values, the frequency components detected by the filter on band No. K and time n, $Y_n(K)$, is $$Y_n(K) = \sum_{m=-\infty}^{\infty} X(m)h(n-m)e^{-j(\frac{2\pi}{N}K)m} \quad (13)$$

$$0 \leqq K \leqq N-1$$

in eq(13), h(n) is the low-pass equivalent impulse response of the filter, n is the time index.

If the important parts from eq (13), are divided into 21 sections and summed, one has:

$$0 \leqq K \leqq N-1 \quad (14)$$

where $$U_n(q) = \sum_{r'=-L}^{L-1} X(n+Nr'+q)h(-Nr'-q) \quad (15)$$

$$0 \leqq q \leqq N-1$$

and $((t))_N$ represents modulo-N value of t, and also eq(14) may be expressed as $$\{Y_n(K), K=0,1,\ldots N-1\} = DFT\{U_n((q-n))_N q=0,1,\ldots N-1\} \quad (16)$$

This equation is in fact eq(2) in the foregoing paragraph except in eq(2) n=rR and $U_n(q)$ should be modified into $U_n((q-n))_N$, i.e., in eq (2) $U_{rR}((q-rR))_N$ is represented as $U_{rR}(q)$ for simplicity of presentation, and the computations of eqs(15) (16) should be performed every R samples, or only when n−rR in the present invention. $Y_n(K)$ here is the frequency components in speech signal and can be scrambled by use of eqs(5),(6) above.

What we have discussed above is simply the method to complete speech analysis of ideal filter bank by means of FFT. Its synthesis method is described as follows:

Let $Y_{rR}(K)$ ($R \leqq N$) be a set of frequency components taken from $Y_n(K)$ at the period of every R samples, i.e., n=rR. According to interpolation theory, the complete sequence $Y_n(K)$ can be obtained by $$Y_n(K) = \sum_{r=L^-}^{L^+} Y_{rR}(K)f(n-rR) \quad (17)$$

in eq(17), f(n) is the interpolating filter impulse response $$L^+ = [n/R]+L,\ L^- = [n/R]-L+1,$$

where [t] means the greatest integer less than t.

But the speech waveform X(n) is related to the frequency components $Y_n(K)$ by $$X(n) = \frac{1}{N}\sum_{K=0}^{N-1} Y_n(K)e^{j(\frac{2\pi}{N}K)n} \quad (18)$$

substituting eq(17) in eq(18), one has $$X(n) \approx \sum_{r'=L^-}^{L^+} f(n-r'R)y_{r'R}((n))_N \quad (19)$$

where $$\{Y_{rR}(n), n=0,1,\ldots,N-1\}32\ IDFT\{Y_{rR}(K), K=0,1,\ldots N-1\} \quad (20)$$

where "IDFT" represents the function of Inverse Discrete Fourier Transform, as used above in eq(6). This is the method to complete speech synthesis by means of inverse FFT. For a more detailed explanation for the speech analysis and synthesis, reference is made to R. L. Rabiner and R. W. Schafter, "Digital Processing of Speech Signals", Chap. 6.

1-3. Summary

From the theory, as long as the sets of frequency components $Y_{rR}(K)$, K=0,1, . . . N−1, r=0,1,2,3, . . . can be obtained with $R \leqq N$ the complete sequences $Y_n(K)$, n=0, 1, 2 . . . K=0, 1, . . . N−1, the original time domain signal, X(n), can be recovered even if the timing is wrong by n such that $Y_{rR+\Delta n}(K)$ instead of $Y_{rR}(K)$ is obtained. Therefore, when the transmitter and receiver are not synchronized but perform the foregoing process once for every R sample periods with $R \leqq N$, the original signal, X(n) can always be recovered. This is the reason why the synchronization is completely unnecessary. The complete operation of the frequency domain scrambling technique is summarized in the following. Eqs(14) (15) may be expressed with n=rR, $$Y_{rR}(K) = \sum_{q=0}^{N-1} U_{rR}((q-rR))_N e^{-j(\frac{2\pi}{N}K)q} \quad (21)$$

$$0 \leqq K \leqq N-1$$

$$U_{rR}(q) = \sum_{r'=-L}^{L-1} X(rR+Nr'+q)h(-Nr'-q) \quad (22)$$

$$0 \leqq q \leqq N-1$$

where r is an integer, because one set of frequency components are obtained for every R samples. Since the procedure for scrambling and descrambling are the same as stated in 1-1, both scrambling and descrambling can be expressed as the following except for descrambling M is replaced by $M^{-1}$ $$\vec{\bar{Y}}_r = W\vec{U}_r \quad (4)$$

$$\vec{Y}_r' = M\vec{Y}_r \quad (5)$$

$$\vec{y}_r = W^{-1}\vec{Y}_r' \quad (6)$$

where $$\vec{Y}_r = [Y_{rR}(K),\ K=0,1,\ldots,N-1]^T \quad (3)$$

$$\vec{U}_r = [U_{rR}((q-rR))_N,\ q=0,1,\ldots N-1]^T \quad (23)$$

$$\vec{\bar{Y}}_r = [Y_{rR}(K),\ K=0,1,\ldots,N-1]^T \quad (24)$$

Note that the definition of $\vec{U}_r$ in eq(23) is slightly different from that in eq(1). In FIG. 1, $P_1$ represents the operation of eqs(22)(23), indicating the procedure to convert X(n) to $\vec{U}_r$, while $P_2$ represents the operation of eq(19), indicating the procedure to convert $\vec{Y}_r$ to X'(n). The blocks W, M, $W^{-1}$ represent the operations in eqs(4), (5), (6), respectively. This describes the frequency domain scrambling technique of this invention. For the time domain scrambling technique in the invention as shown in FIG. 2, the operations of $P_1$, $P_2$ are exactly the same, while the operations of T, $T^{-1}$ are simply multiplying the input vector $U_r$ by the matrices T and $T^{-1}$ as defined in eqs(9~12).

2. SYSTEM DESIGN CONSIDERATIONS

Since the purpose is to accomplish real time operation, the simultaneous processing capabilities of all parts in the system, the interconnection of all parts in the system, and the system processing speed become the essential considerations for system design.

2-1. Simultaneous Processing Capability

Figure 4:
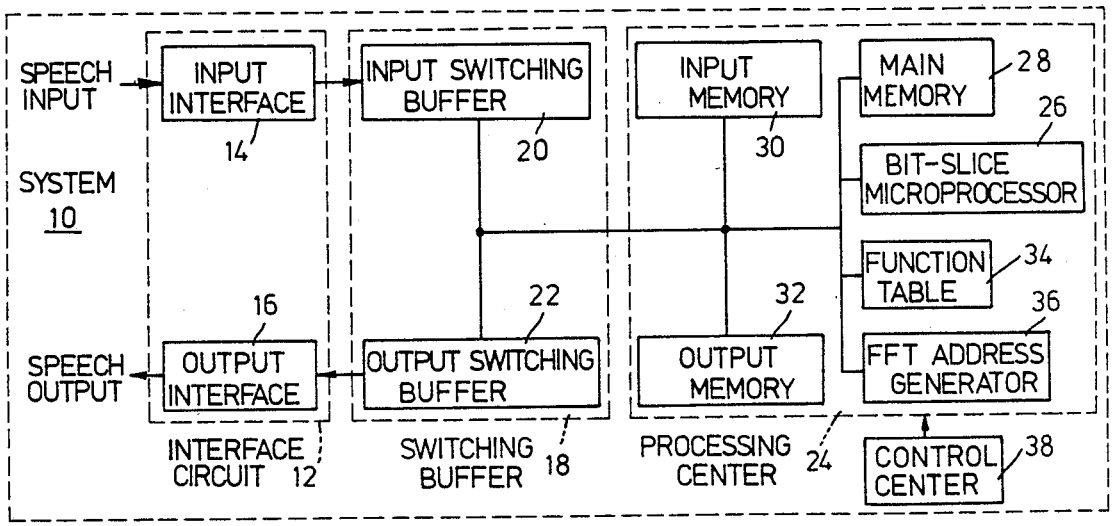
FIG. 4 is a block schematic diagram of hardware in accordance with the present invention.
Figure 5:
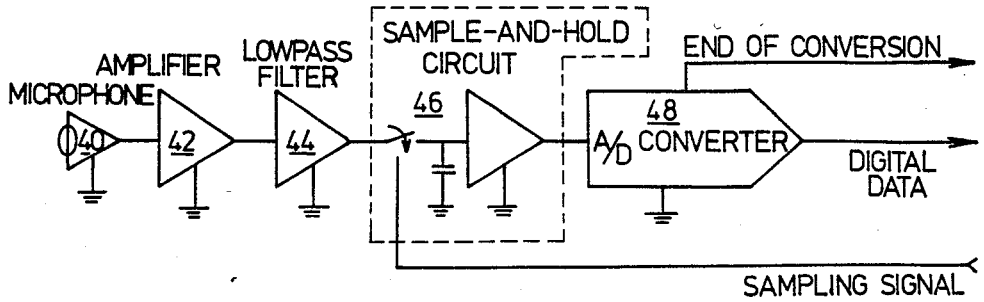
FIG. 5 is a diagram showing the input interface circuit of FIG. 4.
Figure 6:
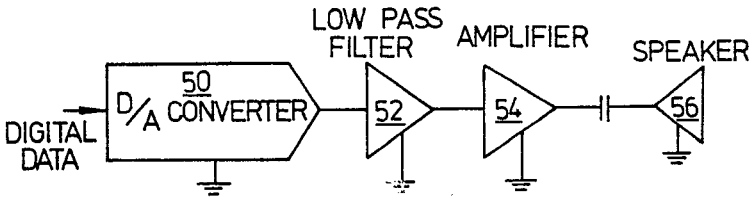
FIG. 6 is a diagram showing the output interface circuit of FIG. 4.

The complete system 10 is shown in FIG. 4 for the frequency domain scrambling system. It can be divided into four main parts:

(A) Interface Circuit 12: It processes filtering and sampling of the analog signal, and conversions between the analog signal and digital data. This circuit is divided into input and output interfaces 14 and 16 respectively; as shown in FIG. 5, input interface 14 consists of an amplifier 42 stage, low-pass filter 44, sample-and-hold circuit 46 and analog-to-digital converter 48 (A/D converter); as shown in FIG. 6, output interface 16 comprises a digital-to-analog (D/A) converter 50, low-pass filter 52 and amplifier 54 stage.

(B) Switching Buffer 18: The switching buffer 18 is divided into input buffer 20 and output buffer 22. Input buffer 20 receives the data from interface circuit 12 and provides the digital data required in processing center 24; output buffer 22 receives the processed digital data from processing center 24 and simultaneously provides the output data for output interface 16.

(C) Processing Center 24: The processing center 24 consists of a bit-slice micro-processor 26, main memory 28, input memory 30 output memory 32 function table 34, and FFT address generator 36. Processing center 24 is capable of performing the calcuations of all the data, scrambling and descrambling, and is responsible for control of data exchange in switching buffer 18.

(D) Control Center 38: The control center 38 is a small microprocessor system mainly composed of a Z-80 CPU. It is responsible for input of cryptograph, generating a cryptograph matrix and control of the interrupt and execution of processing center 24.

The interface circuit 12 and switching buffer 18 are able to process their own incoming and outgoing data by themselves and free from the control of the processing center 24. The processing center 24 performs calculation independently at normal time and is free from restriction of the control center 38.

2-2. Interconnection (A) The interface circuit 12 and switching buffer 18 are able to inform each other of the data transferred between them.

(B) The data transferred between the switching buffer 18 and processing center 24 are controlled by the latter.

(C) The processing center 24 works independently and freely but may be interrupted in operation by the control center 38 at any time when a cryptograph matrix is required to be put in. This interrupt effects loading the cryptograph matrix into the main memory 28.

2-3. Speed of Process

In the described system, the period of clock pulse is 250 ns, while the sampled speed is 8 $KH_z$. After every frame has 256 samples, i.e., N=256, the system has to complete the processing for one frame of data in 32 msec. In eqs(19)(22), taking L=3, then, the data processed in every frame are related to the samples of preceding 5 frames in which data have been stored. The actions of the system to process data includes four kinds of operations:

(A) Data Transfer: The system transfers data between switching buffer 18 and processing center 24.

(B) Data Multiplication: The system performs data multiplication by function value and summation.

(C) FFT and inverse FFT (D) Scrambling and descrambling

According to actual operation, the system's actions are of the following 4 types with total numbers to be completed in 32 msec:

(A) Data transfer among memory units: about 4,000 times (B) Data transfer between memory and central processing unit 26: about 20,000 times (C) Addition: about 15,000 times (D) Multiplication: about 11,000 times If a general microprocessor is used as the central processing unit, it is doubtful whether the above complicated functions can be performed. Therefore, a bit-slice microprocessor is adopted and supplemented with a multiplier 90 in order to increase the operation speed.

3. HARDWARE STRUCTURE

3-1. Interface Circuit 12

(A) Input interface 14: Referring now to FIG. 5, the original signal coming from a microphone 40 passes through a 2-stage amplifier 42 and, a signal 2 volts peak-to-peak amplitude is obtained. This signal is then filtered by a butterworth low-pass filter 44 of order 10 having a cutoff frequency of 3 $KH_z$ and an amplitude response which decreases rapidly to −35 dB at 4 $KH_z$. After filtering, this signal is converted into digital data. Samples are taken by a sample-and-hold circuit 46 at the sampling rate of 8 $KH_z$ and processed by A/D converter 48. Then, A/D converter 48 will generate a EOC (End of Conversion) signal to initiate data transfer into the input buffer 20.

(B) Output Interface 16:

The structure of output interface is simplier than that of input interface. Referrring now to FIG. 6, output interface consists of a D/A converter 50, a low-pass filter 52 of order 6 and an output amplifier 54 to drive a speaker 56.

3-2. Switching Buffer 18

Figure 7:
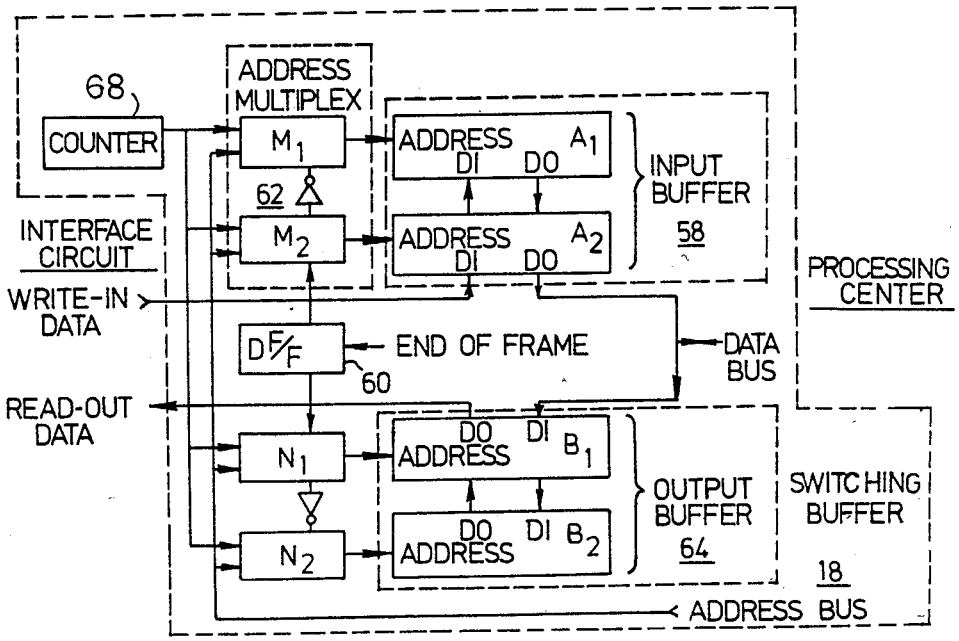
FIG. 7 is a diagram showing the switching buffer of FIG. 4.

(A) Input Buffer 20: As shown in FIG. 7, the input buffer 20 consists of 2 sets of 256×12 bits memory $A_1$ and $A_2$, in which data write-in and read-out are controlled by a D-type flip-flop 60 of one shift per frame. When $A_1$ is used as the data write-in buffer of the interface circuit, $A_2$ will be used as the data read-out buffer of the processing center. $M_1$ and $M_2$ represent mutiplexers 62 controlled by D-type flip-flop 60. The multiplexer-$M_1$ selectively applies a content of the counter 63 as the address of $A_1$ (or $A_2$) and the multiplexer-$M_2$ connects the address bus of the processing center to $A_2$ (or $A_1$). Once the interface circuit data is written, the counter 63 will be incremented by 1. When $A_1$ is filled up the D-type flip-flop will reverse its value to make $A_1$ and $A_2$ exchange their functions. Such operations repeat and continue.

(B) Output Buffer 22: The structure of output buffer 22 is similar to that of input buffer and is also controlled by D-type flip-flop 60 and counter 63. However, different from input buffer, the output buffer reads data from processing center 24 and writes data into output interface circuit 16.

3-3. Processing Center

Figure 8:
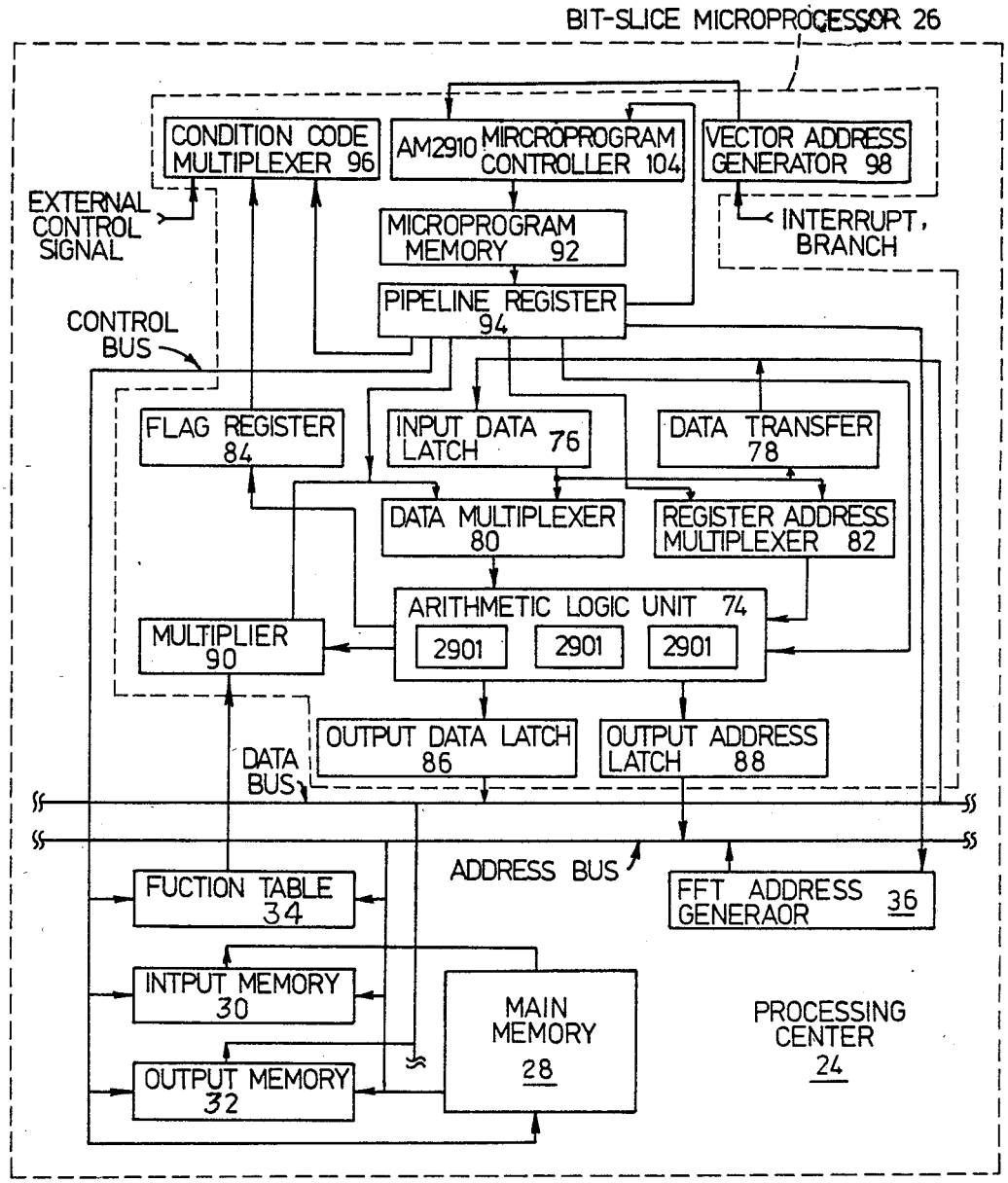
FIG. 8 is a block schematic diagram showing the processing center of FIG. 4.

As shown in FIG. 8, the processing center 24 is composed of an arithmetic logic unit 74 including three data processors AM2901, a microprogram controller 104 (AM2910), a high-speed multiplier 90 (TRW-12HJ), main memory 28, input and output memory 30 and 32 and logic gates. Combining these components, the processing center forms a bit-slice microprocessor system having the following characteristics:

(A) Instructions are controlled by the microprogram so that any special instruction is easily obtained as needed.

(B) Only 1 μsec is needed to transfer data between different memory units.

(C) 12 bits data by 12 bits data fixed point multiplication takes only 250 μsec.

(D) Capacity for processing interrupt and branch signals is provided.

As shown in FIG. 8 the processing center has 3 data processors AM2910 in series to form an arithmetic logic unit (ALU)74 with 4×3=12 bits data length. Arithmetic logic unit 74 cooperates with (A) Input data latch 76: To latch the input data (B) Data Transfer Gate 78: To control transfer of the data in the input latch 76.

(C) Data Multiplexer 80: To determine the data source required by AM2901.

(D) Register Address Multiplexer 82: To determine the source of register address used in AM2901.

(E) Flag Register 84: To hold and refresh the flag conditions.

(F) Output Data Latch 86: To send the processed data out.

(G) Output Address Latch 88: To hold an external memory address.

(H) High-speed Multiplier 90: To execute the operation of multiplication and summation in CPU.

The processing center uses a microprogram controller 104 (AM2910) to generate microprogram addresses in accordance with the system microprogram as well as modified by the external control signal and the flags of the arithmetic logic unit 74. Cooperating with Controller 104 are:

(A) Microprogram Memory 92: A total of 8 memory 256×8 TTL PROMs in series establishes the length of microinstruction at 64 bits. These 64-bit instructions contain enough information to control various conditions occurring in processing center 24.

(B) Pipeline Register 94: The pipeline register consists of eight 8-bit D-type flip-flops used to latch the data of microprogram memory. This register uses the system clock as trigger pulse to update contents.

(C) Condition code multiplexer 96: The condition code multiplexer is controlled by the microprogram. It selects external control signal or flags as reference inputs to microprogram controller 104.

(D) Vector address generator 98: This generator stores the address where the program is branched or interrupted and provides such address to the microprogram controller 104 when necessary.

The function table 34 is programmed into an EPROM, which consists of 2K×12 bits memory to provide special function values required for calculations by the arithmetic logic unit (such as h(n) in eq(22), f(n) in eq(19) and cos(s) sin(s) required in FFT). The function value read out by processing center will be sent to one of the input ports of the high-speed multiplier for multiplication by data applied to another port by arithmetic logic unit 74.

The FFT address generator 36 generates the required address is for FFT computation to increase the speed of the arithmetic logic unit 74.

The main memory 28 having 2K×12 bits in total, stores the cryptograph matrix and computation data.

The input/output memory 30, 32 stores the required 6 frames of data to be processed in every frame of time.

3-4. Control Center 28

Figure 9:
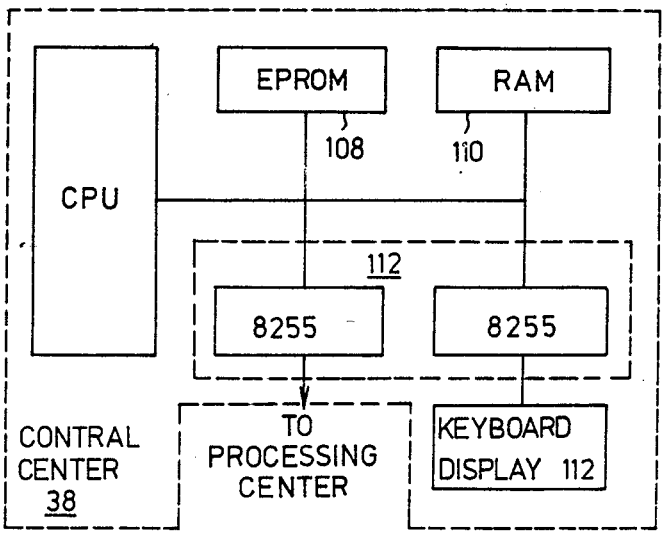
FIG. 9 is a block schematic diagram showing the control center of FIG. 4.

Referring now to FIG. 9, the control center 38 comprises a Z-80 microprocessor system including (A) 1K byte monitor program stored in EPROM 108.

(B) 1K byte RAM 110 used by monitor program for storing at least one cryptograph matrix.

(C) Two 8255 PIO chips 112 for interfacing with keyboard, display 106 and processing center 24.

4. REAL TIME OPERATION PROCEDURE

As previously noted the real time operating procedure of the complete system may be divided into the following five steps expressed mathematically:

$$\text{(A) } U_{rR}(q) \cong \sum_{r'=-L}^{L-1} X(rR + Nr' + q)h(-N' - q) \quad (22)$$

$$0 \leqq q \leqq N - 1$$

$$\text{(B) } \{Y_{rR}(K), K = 0,1, \ldots N - 1\} = DFT\{U_{rR}((q - rR))_N, q = 0,1, \ldots, N - 1\}. \quad (23),(4)$$

$$\text{(C) } \vec{Y}_r' = M\vec{Y}_r \quad (5),(3)$$

$$\text{(D) } \{y_{rR}(n), n = 0,1, \ldots N - 1\} = IDFT\{Y'_{rR}(K), K = 0,1, \ldots, N - 1\}. \quad (6),(24)$$

-continued $$\text{(F) } X'(n) \cong \sum_{r'=L^-}^{L^+} f(n - r'R)y_{rR}((n))_N \tag{19}$$

In these five steps, we take R=N=256, L=3.

Figure 10:
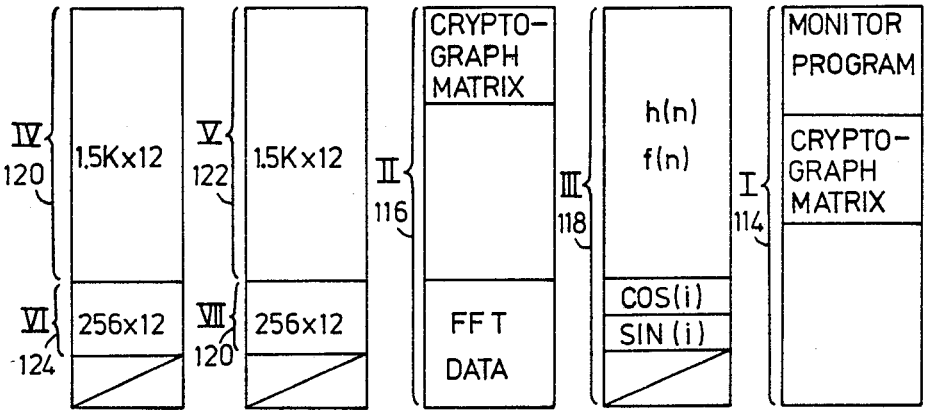
FIG. 10 is a block schematic diagram showing the system memory in accordance with the present invention.
Figure 11:
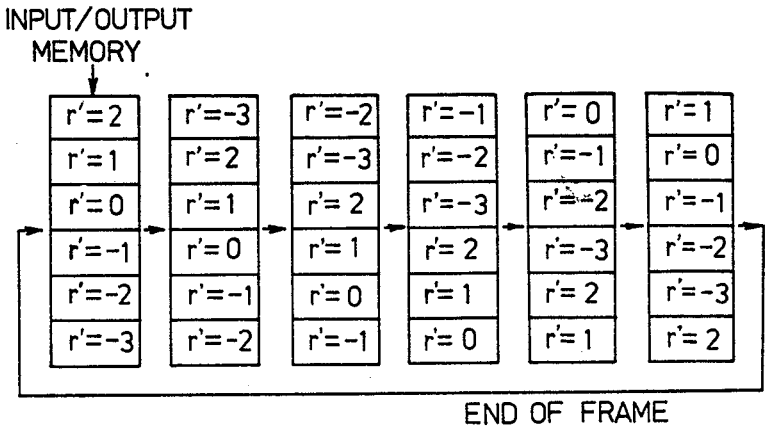
FIG. 11 is a diagram showing the flowchart of the address and time segments in the input memory of FIG. 4.

The memory map of the complete system including a RAM 110 and an Eprom 108 is illustrated in FIG. 10, being divided into seven regions:

(I) Control center memory 108, 110
(II) Main memory 28
(III) Function table 34
(IV) Input memory 30
(V) Output memory 32
(VI) Input buffer 20
(VII) Output buffer 22

Operation of the steps relating to (A)~(E) is described below:

$$\text{Step (A): } U_{rR}(q) \cong \sum_{r'=-L}^{L-1} X(rR + Nr' + q)h(-Nr' - q) \tag{22}$$

$$0 \leqq q \leqq N - 1$$

One frame of the data from input buffer 20 are transferred into input memory 30. This frame of data, together with other five frames of data already stored in the input memory, i.e., a total of six frames of data, are multiplied by the function value h(−Nr'+q) and summed to obtain $U_{rR}(q)$. A cyclic counter is set up here to automatically adjust the input memory's address permanently at r'=−3, whenever a new frame of data is going to be written in. In fact, the contents in memory are not moved, only the address r' is changed. In doing so, the preceding five frames r'=−3, −2, −1, 0, 1 will move forward one frame, and become r'=−1, 0,1,2, while the original frame of r'=2 disappears automatically. The status transition is demonstrated in FIG. 11.

$$\text{Step (B): } \{Y_{rR}(K), K = 0, 1, \ldots, N - 1\} = DFT\{U_{rR}((q - rR))_N, q = 0, 1, \ldots, N - 1\} \ldots \tag{4, 23}$$

Figure 12:
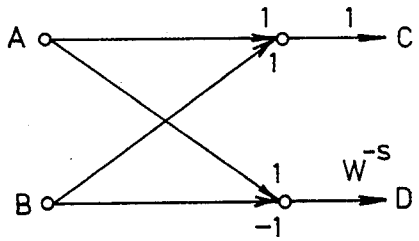
FIG. 12 is a diagram showing the relation between the input and output of butterfly structure in accordance with the present invention.

Because N=R, this simply corresponds to performing 256 decimation in frequency FFT on $U_{rR}$, which includes eight passes, each having 128 butterfly structures (computation). The relation between the input and output data of each butterfly structure is shown in FIG. 12. Mathematically $$\begin{cases} C = A + B & (25) \\ D = (A - B)W^{-s} & (26) \end{cases}$$

if A,B,C,D, are all complex numbers, can be expressed as:

$$\begin{cases} A = a + ja' & (27) \\ B = b + jb' & (28) \\ C = c + jc' & (29) \\ D = d + jd' & (30) \end{cases}$$

-continued $$\begin{cases} c = a + b & (31) \\ c' = a' + b' & (32) \\ d = (a - b)\cos(s) + (a' - b')\sin(s) & (33) \\ d' = (a' - b')\cos(s) - (a - b)\sin(s) & (34) \end{cases}$$

In these eqs, a, b, c, d are the real parts stored in the main memory 68 address 600H; 6FFH; a', b', c', d' are the imaginary parts stored in the main memory 68 addressed 700H~7FFH; and cos(s), sin(s) are the function values stored in the function table 100 addressed 600H~6FFH.

During implementation of the butterfly structure the address of a set of input data (A,B) is the same as that of a set of output data (C,D); while the addresses of the function value, input data and output data are produced by the FFT address generator 36.

Figure 13:
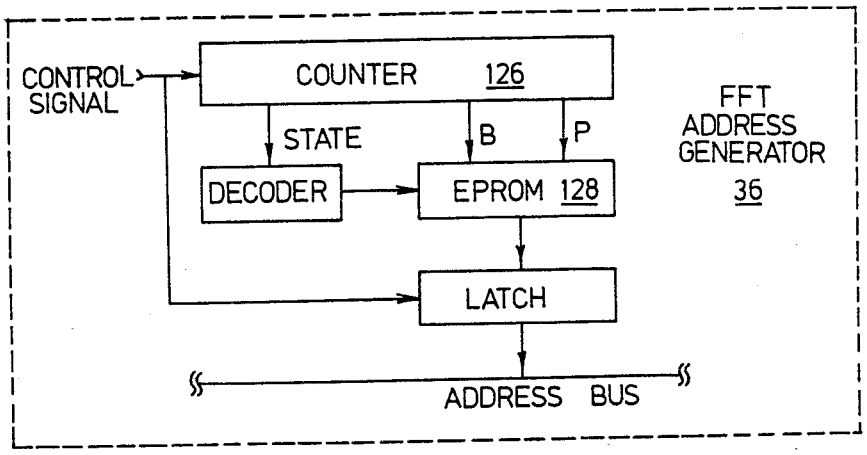
FIG. 13 is a block schematic diagram showing the structure of Fast Fourier Transform (FFT) address generator of FIG. 4.

The address generator 36 is composed of a series of counters 126 together with an EPROM 128 and logic gates (FIG. 13).

Step (C):

$$\vec{Y}_r' = M\vec{Y}_r \tag{5}$$

Since $\vec{U}_{rR}$ is a real variable factor, the frequency component vector obtained, $\vec{Y}_{rR}$, is conjugately symmetrical, i.e.

$$Y_{rR}(K) = Y_{rR}^*(N - K) \quad K = 0, 1, \ldots, N - 1 \tag{35}$$

In order to preserve the symmetrical relation, during scrambling only N/2 samples can move freely while the other N/2 samples are changed accordingly. Hence if N=256, there will be at most 128! different scrambling matrices. This step is to permute $\vec{Y}_{rR}$ into $\vec{Y}_{rR}'$ according to the scrambling matrix M.

$$\text{Step (D): } \{y_{rR}(n), n = 0, 1, \ldots, N - 1\} = IDFT\{Y_{rR}'(K), K = 0, 1, \ldots, N - 1\} \ldots \tag{25, 6}$$

The operation of inverse FFT is the same as that of FFT except that the relation between input and output data is changed. Therefore, $$\begin{cases} C = \frac{1}{2}(A + B) & (36) \\ D = \frac{1}{2}(A - B)W^s & (37) \end{cases}$$

$$\begin{cases} c = \frac{1}{2}(a + b) & (38) \\ C' = \frac{1}{2}(a' + b') & (39) \\ d = \frac{1}{2}[(a - b)\cos(s) - (a' - b')\sin(s)] & (40) \\ d' = \frac{1}{2}[(a' - b')\cos(s) + (a - b)\sin(s)] & (41) \end{cases}$$

During computation the four terms c, c', d, d' have to shift right one bit (divided by two) and then be transferred back to main memory 28 to complete operation of the butterfly structure.

$$\text{Step (E): } X'(n) \cong \sum_{r'=L^-}^{L^+} f(n - r'R)y_{rR}((n))_N \tag{19}$$

The $y_{rR}(n)$ value is multiplied by the interpolating function and summed with the preceding five frames of data to get X'(n). X'(n) are then transferred into the output buffer 22.

Time required for each step n is as follows:

Step (A): 4 msec
Step (B): 9 msec
Step (C): 2 msec
Step (D): 9 msec
Step (E): 4 msec
Other: 2 msec A total of 30 msec is required for implementation. There is still about 2 msec additional margin compared with the usage maximum period of frame 32 msec.

Described above is the complete structure and operation of the frequency domain technique of this invention. For the time domain technique, the structure and operation is similar except everything has to do with FFT and inverse FFT is eliminated, and the scrambling matrix M is replaced by the "linear combination of uniform permutation" T described in eqs (9)~(12).

What is claimed is:

1. Apparatus, responsive to an audio frequency analog input signal applied thereto, for generating a scrambled audio frequency analog signal for transmission, said apparatus comprising:

input interface means, responsive to said analog input signal, for sampling said analog input signal at a predetermined rate, and generating digital data signals representative of said samples;

input switching buffer means, responsive to said digital data signals, for grouping said digital data signals into successive digital data frames (Xr) each representing a predetermined number (N) of samples, where $X_r(q)$; $r=0,1,2\ldots$; $q=1,\ldots N-1$;

input memory means, responsive to signals indicative of said digital data frames, for storing indicia of a predetermined number (2L) of successive digital data frames;

filter means, responsive to said stored data frame indicia, and signals indicative of a predetermined filter function $h(-Nr'+q)$, to calculate a time domain digital vector $\vec{U}_{rR}$, where $$\vec{\vec{U}}_{rR}(q) \cong \sum_{r'=-L}^{L} X(rR+Nr'+q)h(-Nr'-q) \text{ where } 0 \leqq q \leqq N-1,$$

the elements of said vector being indicative of the corresponding frequency (k) component value of the corresponding sample;

Fourier transform means, responsive to signals indicative of said digital vector $[U_{rR}(q), 0 \leqq q \leqq N-1]^T$, for generating a frequency domain digital vector $[Y_{rR}(k), K=0, 1\ldots N-1]^T$ where $\{Y_{rR}(k), k=0,1,\ldots n-1\}=\text{DFT}\{U_{rR}((q-rR))_{moduloN}, q=0,1,\ldots N-1\}$, where DFT represents the Discrete Fourier Transform operator;

permutator means, responsive to signals indicative of said frequency domain digital vector $Y_{rR}(k)$, $k=0, 1\ldots N-1$, and signals indicative of a predetermined N by N cryptographic matrix M, for generating a scrambled frequency domain digital vector $\vec{Y}_r'=M\vec{Y}_r$ inverse Fourier Transform means, responsive to signals indicative of said scrambled frequency domain digital vector $Y_r'(k)$, $K=0, 1\ldots N-1$, for generating a scrambled time domain digital vector $[y_{rR}(q), q=0, 1\ldots N-1]^T$ where $$\{y_{rR}(q), q=0,1,\ldots N-1\}=IDFT\{Y'_{rR}(k), k=0, 1\ldots N-1\},$$

where IDFT is the inverse Discrete Fourier transform operator;

interpolation means, responsive to signals indicative of said scrambled time domain vector $[Y_{rR}(q), q=0, 1\ldots N-1,]^T$ and signals indicative of a predetermined interpolation function f(q), for generating an interpolated scrambled digital signal $X'_{rR}(n)$, where:

$$X_{r'R}(n) = \sum_{r'=Z-L+1}^{Z+L} f(n-r'R)y_{rR}(n_{modulo\ N})$$

where Z is the greatest integer less than q/R; and output buffer means, responsive to signals indicative of said interpolated digital signal $X_{rR}'(n)$, for generating a scrambled audio frequency analog signal corresponding to said interpolated vector $X_{rR}'(q)$ for transmission.

2. A speech scrambling system, of the type responsive to an audio frequency signal, and including a sender for transmitting a scrambled signal indicative of said audio frequency signal, and a receiver for descrambling said scrambled signal, which does not require any frame synchronization, comprising:

input interface means for generating a serial digital signal indicative of frames of samples selected from said audio-frequency signal;

input buffer means for buffering such digital signal;

input memory means for temporarily registering respective frames of said serial digital signal;

scrambling/descrambling controller means for rearranging the order of said digital signal in said input memory means, and selectively scrambling or descrambling each successive frame of said digital signal, said controller comprising: main memory means for pre-registering at least one cryptograph matrix, function table memory means for storing specific numerical values to be used in scrambling and descrambling process, FFT address generator means for performing FFT of the data in the input memory means in cooperation with both the function table memory means, and system control means for controlling operation of said scrambling-/descrambling controller means, output memory means for preregistering the transformed digital signal that is originally the data in said input memory means after being processed by the scrambling/descrambling controller means, and output buffer means for buffering such signal;

output interface means for converting the transformed digital signal from said output buffer means into an analog signal; said analog signal being amplified and transformed into sound wave through a loudspeaker.

3. The system as claimed in claim 2, further including means, responsive to at least one of an original input audio frequency signal to said sender or transformed audio frequency signal to said receiver for selecting one frame of the audio frequency analog signal from continuous readings and convert it into serial digital signal; and treating a series of signals selected at random from the continuous readings as a whole unit, selectively scrambling or descrambling each signal in this unit by re-arranging this order such that the frame synchronization is not required.

4. The system as claimed in claim 3, wherein said means for randomly selecting one frame of the analog signals from continuous readings, comprise means for transforming said read-out continuous analog signal into a series of digital signals, treating the whole process for this serial digital signal as one unit.

5. The system as claimed in claim 3, further including means for treating the frame of the serial digital signal as one unit, and scrambling or descrambling each signal in this unit by re-arranging their order.

6. The system as claimed in claim 2, including means, responsive to the scrambled or descrambled output digital signal by either the sender or receiver for transforming this digital signal through a serial process and a D/A convertor back to the audio frequency analog signal.

7. The system as claimed in claim 4, further including means, responsive to said unit serial digital signal, for forming a nominal digital vector $\vec{U}_r$ according to the following equation:

$$U_{rR}(q) = \sum_{r'=-L}^{L-1} X(rR + Nr' + q)h(-Nr' - q)$$

$$\vec{U}_r = [U_{rR}((q - rR))_N, q = 0,1, \ldots, N - 1]^T.$$

8. The system as claimed in claim 6, including means responsive to at least one of the scrambled or descrambled output digital signal by either the sender or receiver, for transforming it back into audio frequency signal according to following equations:

$$X(n) = \sum_{r'=L^-}^{L^+} f(n - r'R)Y_{rR}((n))_N$$

9. The system as claimed in claim 2, including a D/A converter in said sender, receptive of scrambled output digital signal, for transforming said scrambled digital signal into one frame of the audio-frequency analog signal.

* * * * *